US007493909B2

(12) United States Patent
Ma

(10) Patent No.: US 7,493,909 B2
(45) Date of Patent: Feb. 24, 2009

(54) UMBRELLA ASSEMBLY WITH TILT ADJUSTMENT

(76) Inventor: Oliver Joen-an Ma, 29 W. Wisteria, Arcadia, CA (US) 91007

( * ) Notice: Subject to any disclaimer, the term of this patent is extended or adjusted under 35 U.S.C. 154(b) by 179 days.

(21) Appl. No.: 11/211,127

(22) Filed: Aug. 24, 2005

(65) Prior Publication Data

US 2006/0201542 A1 Sep. 14, 2006

(30) Foreign Application Priority Data

Mar. 11, 2005 (CN) ..... 2005 2 0100913

(51) Int. Cl.
*A45B 17/00* (2006.01)

(52) U.S. Cl. ..... 135/20.3; 135/21; 135/20.1

(58) Field of Classification Search ..... 135/21, 135/20.1, 20.3, 98
See application file for complete search history.

(56) References Cited

U.S. PATENT DOCUMENTS

| | | | | |
|---|---|---|---|---|
| 2,235,518 | A | 3/1941 | Goshaw | |
| 2,475,406 | A | 7/1949 | Russell | |
| 2,661,752 | A | 12/1953 | Kampf et al. | |
| 2,905,187 | A * | 9/1959 | Croce | 135/20.1 |
| 3,120,238 | A | 2/1964 | Glatz | |
| 3,145,720 | A | 8/1964 | Torii | |
| 4,586,525 | A | 5/1986 | Glatz et al. | |
| 4,622,987 | A | 11/1986 | Redl et al. | |
| 4,674,523 | A | 6/1987 | Glatz | |
| 4,697,606 | A | 10/1987 | Ma | |
| 4,878,509 | A | 11/1989 | Tung | |
| 5,002,081 | A | 3/1991 | Stromeyer | |
| 5,029,596 | A | 7/1991 | Tung | |
| 5,156,395 | A | 10/1992 | Smith | |
| 5,161,764 | A | 11/1992 | Roney | |
| 5,349,975 | A | 9/1994 | Valdner | |
| 5,499,644 | A | 3/1996 | Geniele | |
| 5,584,564 | A | 12/1996 | Phyle | |

(Continued)

FOREIGN PATENT DOCUMENTS

CN 2419864 Y 2/2001

(Continued)

OTHER PUBLICATIONS

U.S. Appl. No. 11/066,132, filed Feb. 24, 2005, Ma.

(Continued)

*Primary Examiner*—David Dunn
*Assistant Examiner*—Noah Chandler Hawk
(74) *Attorney, Agent, or Firm*—Knobbe Martens Olson & Bear LLP

(57) ABSTRACT

An umbrella is provided that includes a support pole, at least a portion of which extends upwardly in use, a suspending pole, a canopy, and a mechanism for rotating the suspending pole about its longitudinal axis. The suspending pole is mounted transversely to the support pole and has first and second ends and a longitudinal axis. The canopy is suspended in use from the second end of the support pole. The mechanism includes a plurality of gear teeth coupled with the suspending pole to cause the suspending pole to rotate in either direction about said axis upon movement of the gear teeth and to thereby cause the canopy to tilt in either direction about said axis.

23 Claims, 9 Drawing Sheets

U.S. PATENT DOCUMENTS

| | | | | |
|---|---|---|---|---|
| 5,611,364 | A | 3/1997 | Woods | |
| 5,678,585 | A | 10/1997 | May | |
| 5,735,302 | A * | 4/1998 | Saliva | 135/20.1 |
| 5,785,069 | A | 7/1998 | Glatz | |
| D398,443 | S | 9/1998 | Bolle | |
| 5,845,665 | A | 12/1998 | Koehn | |
| 5,937,882 | A | 8/1999 | Harbaugh | |
| 6,014,980 | A | 1/2000 | Glatz | |
| D434,215 | S | 11/2000 | Lin | |
| 6,152,156 | A | 11/2000 | Tung | |
| D434,556 | S | 12/2000 | Lin | |
| 6,220,261 | B1 | 4/2001 | Glatz | |
| 6,311,705 | B1 | 11/2001 | Ma | |
| 6,478,037 | B2 * | 11/2002 | Tung | 135/21 |
| 6,520,192 | B1 * | 2/2003 | Lo | 135/25.4 |
| 6,575,182 | B2 | 6/2003 | Tung | |
| 6,575,183 | B2 | 6/2003 | Tung | |
| D477,458 | S | 7/2003 | Goldwitz | |
| 6,588,438 | B1 | 7/2003 | Steiner | |
| 6,619,306 | B2 | 9/2003 | Ma | |
| 6,662,815 | B2 | 12/2003 | Tung | |
| D497,479 | S | 10/2004 | Yu | |
| 6,837,255 | B2 | 1/2005 | Bunch et al. | |
| 6,840,253 | B2 * | 1/2005 | Ma | 135/20.1 |
| 6,851,823 | B2 | 2/2005 | Bilotti | |
| 6,923,193 | B2 * | 8/2005 | Chen | 135/20.1 |
| 6,926,019 | B2 | 8/2005 | Glatz | |
| 6,953,043 | B2 | 10/2005 | Yu | |
| D518,629 | S | 4/2006 | Ma | |
| 2002/0083969 | A1 | 7/2002 | Tung | |
| 2002/0104557 | A1 | 8/2002 | Tung | |
| 2003/0010366 | A1 | 1/2003 | Glatz | |
| 2003/0015230 | A1 | 1/2003 | Glatz | |
| 2004/0031513 | A1 | 2/2004 | Bunch et al. | |
| 2004/0055627 | A1 | 3/2004 | Moga | |
| 2004/0055628 | A1 | 3/2004 | Yu | |
| 2004/0069333 | A1 | 4/2004 | Ma | |
| 2004/0182429 | A1 | 9/2004 | Chen | |
| 2005/0183762 | A1 * | 8/2005 | Ma | 135/145 |
| 2005/0229957 | A1 | 10/2005 | Glatz | |
| 2005/0268952 | A1 | 12/2005 | Ma | |
| 2006/0278262 | A1 | 12/2006 | Ma | |

FOREIGN PATENT DOCUMENTS

| | | | |
|---|---|---|---|
| DE | 580503 | | 7/1933 |
| DE | 3229776 | | 4/1983 |
| DE | 3229776 | A1 | 4/1983 |
| DE | 3820573 | A1 | 8/1989 |
| DE | 202 05 561 | U1 | 7/2002 |
| EP | 0 392 989 | | 10/1990 |
| EP | 1 400 186 | | 3/2004 |
| GB | 22218 | | 9/1911 |
| WO | WO 97/04682 | | 2/1997 |
| WO | WO 00/55456 | | 9/2000 |
| WO | WO 00/55456 | A | 9/2000 |
| WO | WO 2005/018369 | A1 | 3/2005 |

OTHER PUBLICATIONS

U.S. Appl. No. 11/134,074, filed May 20, 2005, Ma.
U.S. Appl. No. 11/211,127, filed Aug. 24, 2005, Ma.
Page 2 of Treasure Garden, Inc.'s product brochure identified as "AG3 9' Centilever Umbrella."
Notice of Allowability regarding U.S. Appl. No. 11/134,074.
European Patent Application No. 05255414.4 Search Report dated Jun. 6, 2006.
U.S. Appl. No. 11/324,952, filed Jan. 4, 2006, Ma.
Operation Manual Easy Sun Parasol Sunshade (Issue: Jul. 2004) pp. 1-17.

* cited by examiner

UMBRELLA ASSEMBLY WITH TILT ADJUSTMENT

CROSS-REFERENCE TO RELATED APPLICATIONS

This application claims priority under 35 U.S.C. §119(a) to Utility Model No. 200520100913.7, filed Mar. 11, 2005 in the Peoples Republic of China.

BACKGROUND OF THE INVENTION

1. Field of the Invention

The invention relates to the field of shade structures, particularly umbrella and parasol devices and more particularly to an umbrella or parasol with an adjustable tilt feature.

2. Description of the Related Art

Umbrellas or parasols are devices which are typically utilized in an outdoor setting, such as in an outdoor patio, balcony, garden, cafe, and the like to provide shade and protection against the elements. Umbrellas or parasols generally include a canopy assembly that is frequently generally circular and which comprises fabric-like material mounted over a plurality of support ribs. The support ribs can be collapsed into a storage position for the canopy and can be deployed and supported in position to hold up and extend the fabric canopy and thereby provides shade and protection from the elements. The canopy assembly is generally supported above users of the umbrella or parasol, generally either by support structures that extend from the ground to underneath the canopy assembly, or by support structures that extend to above the canopy assembly and support it from above. Such suspended umbrellas have the advantage of providing space below the canopy where people can sit without the obstruction of a pole extending from below the canopy to the ground.

One consideration in the use and design of umbrellas or parasols is that the incident sunlight and environmental elements which the users may wish to be shielded against, for example rain which may be wind-driven, is subject to change. As another example, the incident angle of sunlight changes throughout the course of a day as the sun traverses across its daily path. Similarly, wind can come from any direction and can cause rain to fall from a variety of directions other than generally vertically. Thus, in many applications, it is a desirable feature that an umbrella or parasol assembly be provided with some sort of adjustment or variable positioning to accommodate such shifts in the direction of sun, wind and weather generally.

For example, Patent Application Publication No. US 2004/0069333 A1 listing Ma as inventor discloses an umbrella in which a shade canopy is suspended from a side arm that is mounted to a side post. The side arm, and thereby the canopy, can be rotated between specific positions by means of a drive bar that can be manipulated to both rotate the side arm and latch it in one of the positions. Thus, while this design provides some ability to tilt the canopy by rotation of its suspending side arm, that rotation can only be achieved between fixed latch positions and is therefore of limited convenience.

U.S. Pat. Nos. 6,152,156 and 6,478,037 to Tung disclose another variation of a sunshade with tiltable canopy, wherein a canopy assembly is suspended from above by an arcuate tube that is hingedly connected to a generally vertically extending support pole. Thus, by adjustment of the hinged interconnection between the arcuate tube and the vertical support pole, the canopy assembly of the Tung '156 and '037 devices can be tilted inwards and outwards from a generally vertically extending orientation. However, this construction appears to only offer a tilt in a single direction away from the generally vertical support pole.

SUMMARY OF THE INVENTION

One embodiment of this invention provides an umbrella assembly that comprises a support pole assembly, a canopy assembly, and a tilting device. The support pole assembly comprises a supporting pole or tube having a lower end and an upper end, a housing or holding sleeve coupled with the upper end of the supporting pole or tube and a suspending pole or tube extending through the housing or holding sleeve and having a first end and a second end. The canopy assembly is coupled with the second end of the suspending tube for suspension below the second end of the suspending tube. In a preferred embodiment, the tilting device comprises a worm gear and a plurality of gear teeth. Preferably, the worm gear is coupled with a shaft rotatably journaled on the support pole assembly and is configured to be driven by a crank member. The plurality of gear teeth is preferably coupled with an outer or external surface of the suspending tube and can be located for convenience of operation adjacent the first end thereof. The gear teeth are engaged by the worm gear such that rotation of the worm gear causes the suspending tube to rotate about its longitudinal axis. Thus, the canopy assembly can be tilted about the axis of the suspending tube and extended or retracted with respect to the supporting tube, by movement through the holding sleeve.

In one preferred embodiment, a tilting device is configured to tilt the canopy assembly to any position between at least about +90 degrees from vertical and about −90 degrees from vertical.

Preferably, the umbrella assembly of the invention comprises a strut, having an upper end and a lower end, that is preferably coupled at its lower end with the supporting tube and at the upper end with the suspending tube adjacent the first end thereof. Each end of the strut is hingeably coupled, to permit movement of the suspending tube through the holding sleeve.

In another embodiment of the invention, an umbrella assembly is provided that comprises a support pole, a suspending tube, a canopy assembly, a first mechanism for rotating the suspending tube about its longitudinal axis, and a second mechanism permitting retraction and extension of the suspending tube relative to the support pole. The support pole has a lower end and an upper end. The suspending tube has first and second ends and is coupled with the support pole. The suspending tube is movable relative to the support pole between an extended position and a retracted position, wherein the second end is farther from the support pole in the extended position than in the retracted position. The canopy assembly is coupled with the second end of the suspending tube for suspending a canopy fabric. The first mechanism comprises a driven member coupled with the suspending tube, such as with an outer or external surface. The first mechanism is configured to transmit a force to the driven member to cause the suspending tube to rotate in either direction about said axis upon movement of the driven member and to thereby cause the canopy to tilt in either direction about said axis. The second mechanism comprises a gripping surface configured to apply sufficient force to the suspending tube, such as to an outer or external surface to fix the position of the suspending tube relative to the support pole.

In another embodiment of the invention, an umbrella is provided that comprises a support pole, at least a portion of which extends upwardly in use, a suspending pole, a canopy, and a mechanism for rotating the suspending pole about its longitudinal axis. The suspending pole is mounted transversely to the support pole and has first and second ends and a longitudinal axis. The canopy is suspended in use from the second end of the suspending pole. The mechanism preferably comprises a plurality of gear teeth coupled with the suspending pole, such as on an external or outer surface, to cause the suspending pole to rotate in either direction about said axis upon movement of the gear teeth and to thereby cause the canopy to tilt in either direction about said axis.

Preferably the gear teeth in these embodiments form a ring gear.

Another aspect of this invention provides an umbrella assembly or umbrella, as described above, further comprising a locking device having a first configuration preventing movement of the suspending tube relative to the holding sleeve and a second configuration permitting movement of the suspending tube relative to the holding sleeve. Preferably, the locking device comprises an advanceable member advanceable over the suspending tube and coupled with the holding sleeve and a wedge member having a gripping surface facing the suspending tube, wherein a friction force directed from the gripping surface to the suspending tube is increased as the advanceable member is advanced relative to the holding sleeve. More preferably, the advanceable member comprises a ring having internal threads, the first end of the holding sleeve comprising external threads configured to mate with the internal threads of the ring, and wherein the wedge member is located between the ring and the holding sleeve, whereby rotation of the ring about the longitudinal axis of the suspending tube advances the ring relative to the holding sleeve to increase the friction force directed from the gripping surface to the suspending tube.

In a preferred embodiment, a limiter device is coupled with the suspending tube to limit the movement of the ring relative to the holding sleeve.

Thus in a preferred embodiment, the ring gear extends around the suspending tube, most preferably around its outer surface. The gear teeth and in particular the ring gear provide a means enabling the suspending pole to be easily rotated about its axis in either direction and to any extent or degree desired. This rotation or tilting is achieved seamlessly, without being limited to particular positions or orientations.

BRIEF DESCRIPTION OF THE DRAWINGS

Some preferred embodiments of the invention will now be more particularly described by reference to the accompanying drawings, in which.

DETAILED DESCRIPTION OF PREFERRED EMBODIMENTS

Figure 1:
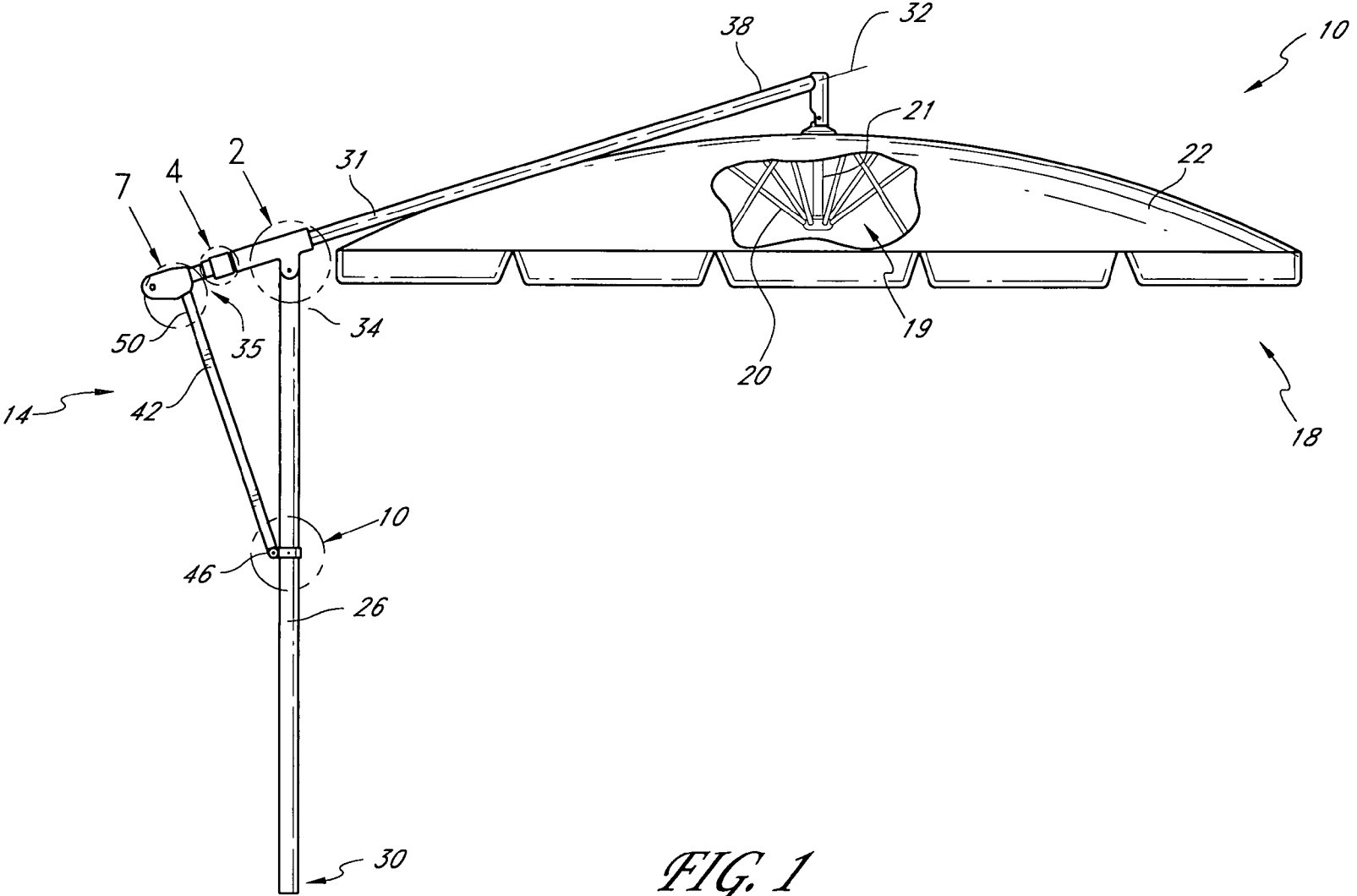
FIG. 1 is a plan view of an umbrella according to one embodiment of the invention, with a canopy thereof shown in an open configuration.

FIG. 1 illustrates one embodiment of an umbrella 10 that can be positioned in a variety of useful positions to provide shelter. To achieve this, as discussed further below, the umbrella 10 includes a plurality of mechanisms to move a sheltering member, e.g., a canopy assembly or a canopy fabric, between the plurality of useful positions.

The umbrella 10 includes a support pole assembly 14 and a canopy assembly 18. As discussed further below, a mechanism is provided to position the canopy assembly 18, for example, by tilting a portion of the support pole assembly 14. The canopy assembly 18 includes a canopy frame (shown in part in FIG. 1) and a canopy fabric 22. The canopy frame can take any suitable form and preferably is able to be opened and closed, such that the canopy fabric 22 can be expanded to provide shelter or closed to take up a minimum of space.

Figure 1A:
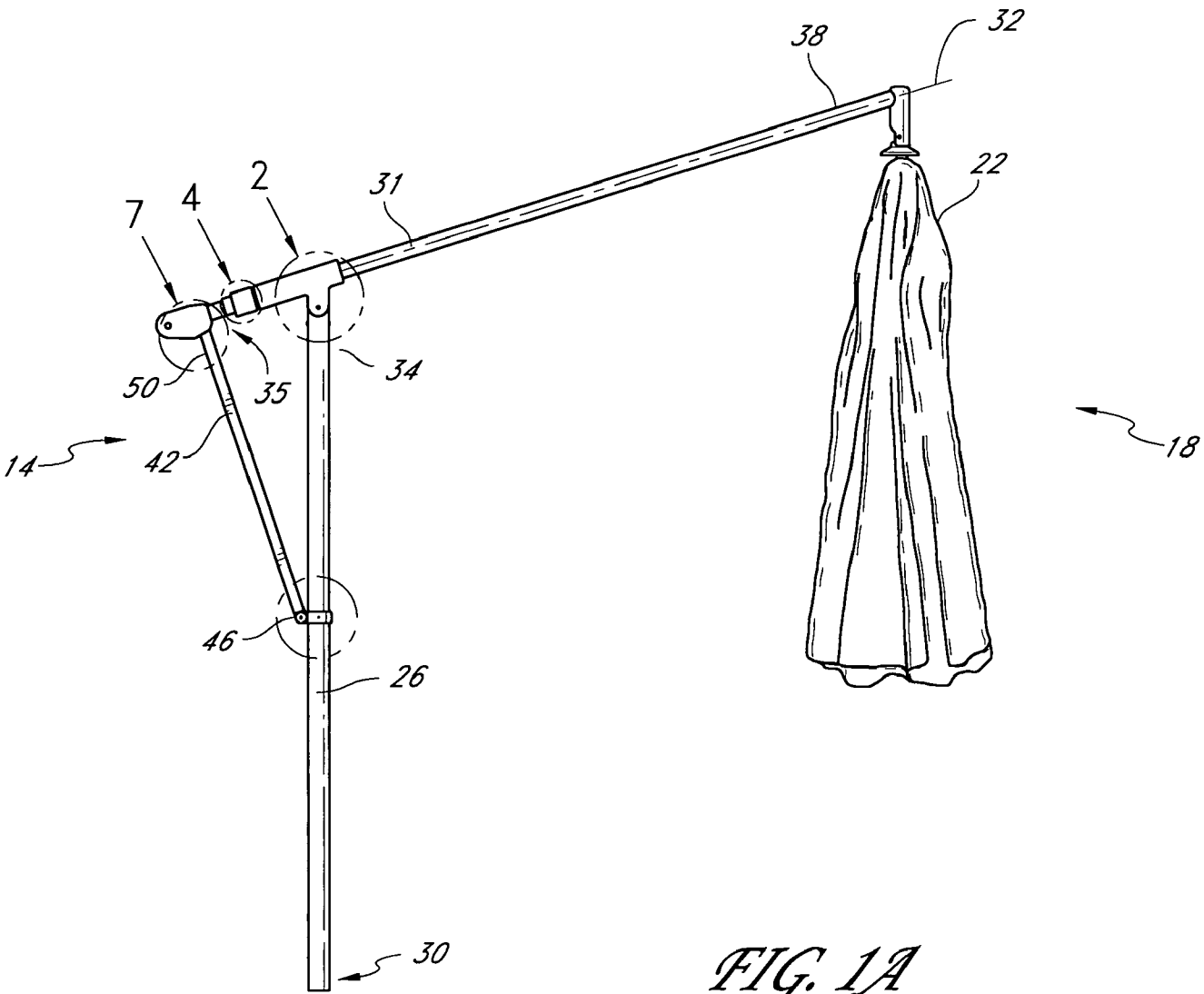
FIG. 1A is a plan view of the umbrella of FIG. 1, with the copy shown in a closed, extended configuration.
Figure 3:
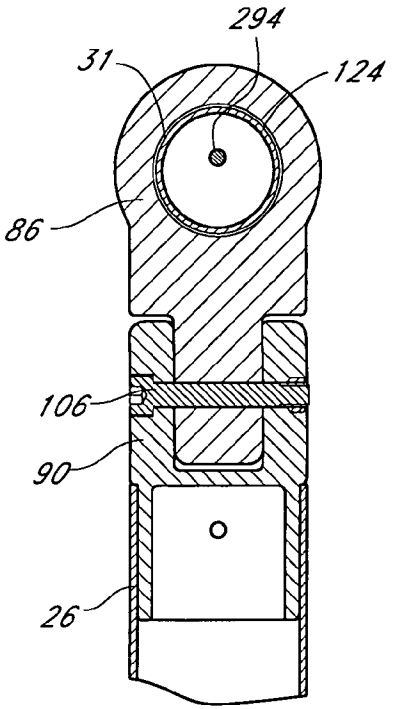
FIG. 3 is a cross-sectional view taken along section 3-3 shown in FIG. 2.

In one embodiment of the invention, the canopy assembly 18 comprises a rib assembly 19 that includes a plurality of ribs 20. The ribs extend from a central shaft 21. The canopy fabric 22 can be a natural or synthetic material and can be extended over the ribs 20. The ribs 20 preferably are movable along the shaft 21 to open and close the canopy assembly 18. As discussed further below, in some embodiments, the umbrella 10 includes a mechanism for opening and closing the canopy assembly 18. An example of the umbrella canopy in a closed position is shown in FIG. 1A.

The support pole assembly 14 is configured to position the canopy assembly 18 as needed. In one embodiment, the support pole assembly 14 includes a supporting tube 26 that extends between a lower end 30 and an upper end 34. The support pole assembly 14 also includes a suspending tube 31 that extends between a first end 35 and a second end 38. The first end 35 is a lower end of the suspending tube 31 and the second end 38 is an upper end of the suspending tube 31. The canopy assembly 18 can be coupled with the second end 38 of the suspending tube 31 in any suitable manner. The suspending tube 31 is coupled with the supporting tube 26 in a manner that permits the canopy fabric to be tilted about a longitudinal axis 32 of the suspending tube 31, and enables the suspending tube 31 to be extended and retracted relative to the supporting tube 26.

Figure 10:
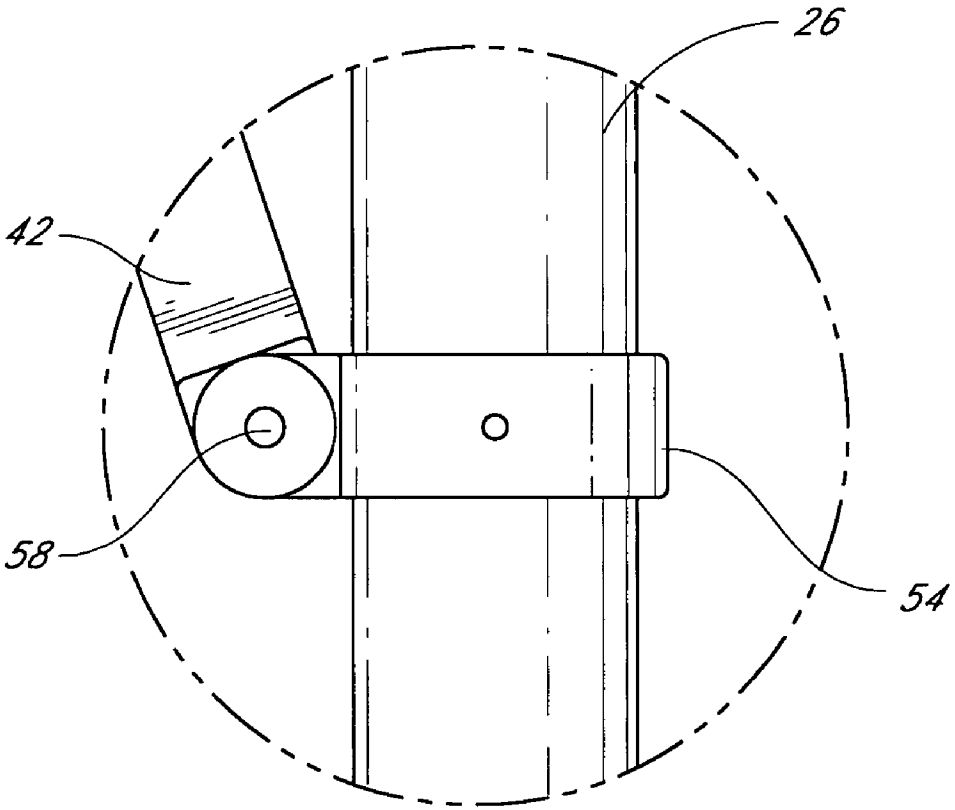
FIG. 10 is an enlarged detail view of section 10-10 showing the mounting of a strut to a supporting tube.

In one embodiment, the support pole assembly 14 also includes a strut 42. The strut 42 extends between a lower end 46 that is coupled with the supporting tube 26 and an upper end 50 that is coupled with the suspending tube 31. Preferably, the lower end 46 of the strut 42 is pivotably coupled with the supporting tube 26 at a location between the upper end 34 and the lower end 30 thereof. The strut 42 is preferably pivotably coupled with the supporting tube 26 by positioning a mounting ring 54 between the upper and lower ends 34, 30 of the supporting tube 26. Ring 54 is preferably located approximately midway between the upper and lower ends 30, 34 of the supporting tube 26. Some preferred features of such an arrangement are shown in FIG. 10, where a pivot shaft 58 is mounted to the mounting ring 54 and to the lower end 46 of the strut 42 to enable the strut 42 to rotate about a central axis of the pivot shaft 58. In an alternative embodiment, the mounting ring 54 can be positioned at any selected position along the supporting tube 26. In the illustrated embodiment, the mounting ring 54 is fixed to the supporting tube 26 and does not move along the supporting tube 26. It will be appreciated that other means may be used to connect strut 42 to support tube 26 besides ring 54, such as bolts and a flange or the like.

Figure 9:
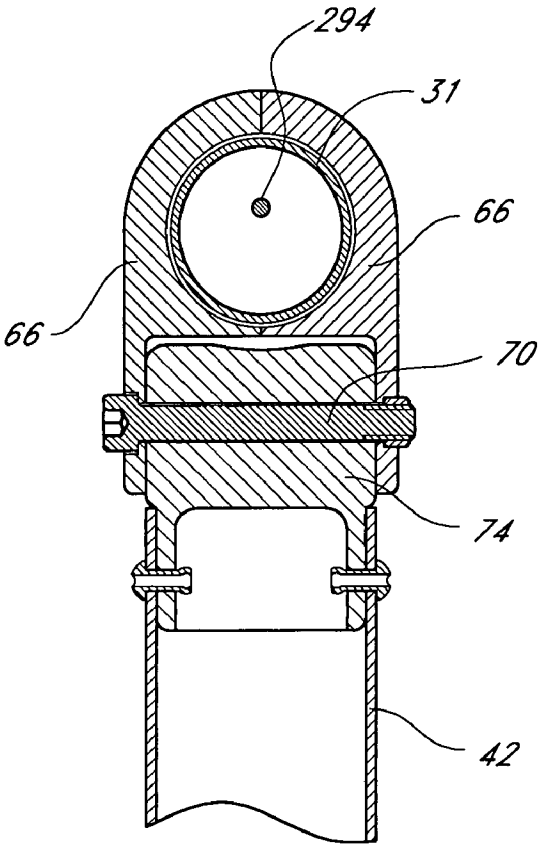
FIG. 9 is a cross-sectional view taken at section 9-9 of FIG. 7.

In one embodiment, the upper end 50 of the strut 42 is pivotably connected directly or indirectly to suspending tube 31. Preferably, upper end 50 of strut 42 is connected with a housing 66 located, as shown in FIG. 9, at the first end 35 of the suspending tube 31. In one embodiment, shown in FIG. 7, a pivot shaft 70 is mounted in a fitting 74 that is coupled with the upper end 50 of the strut 42. The fitting 74 can be coupled with the upper end 50 in any suitable manner, e.g., using a bolt, a rivet, or another suitable fastener. The pivotal coupling of the upper and lower ends 50, 46 of the strut 42 enable the strut 42 to rotate while the suspending tube 31 is being extended or retracted relative to the supporting tube 26, as will be discussed further below.

Figure 2:
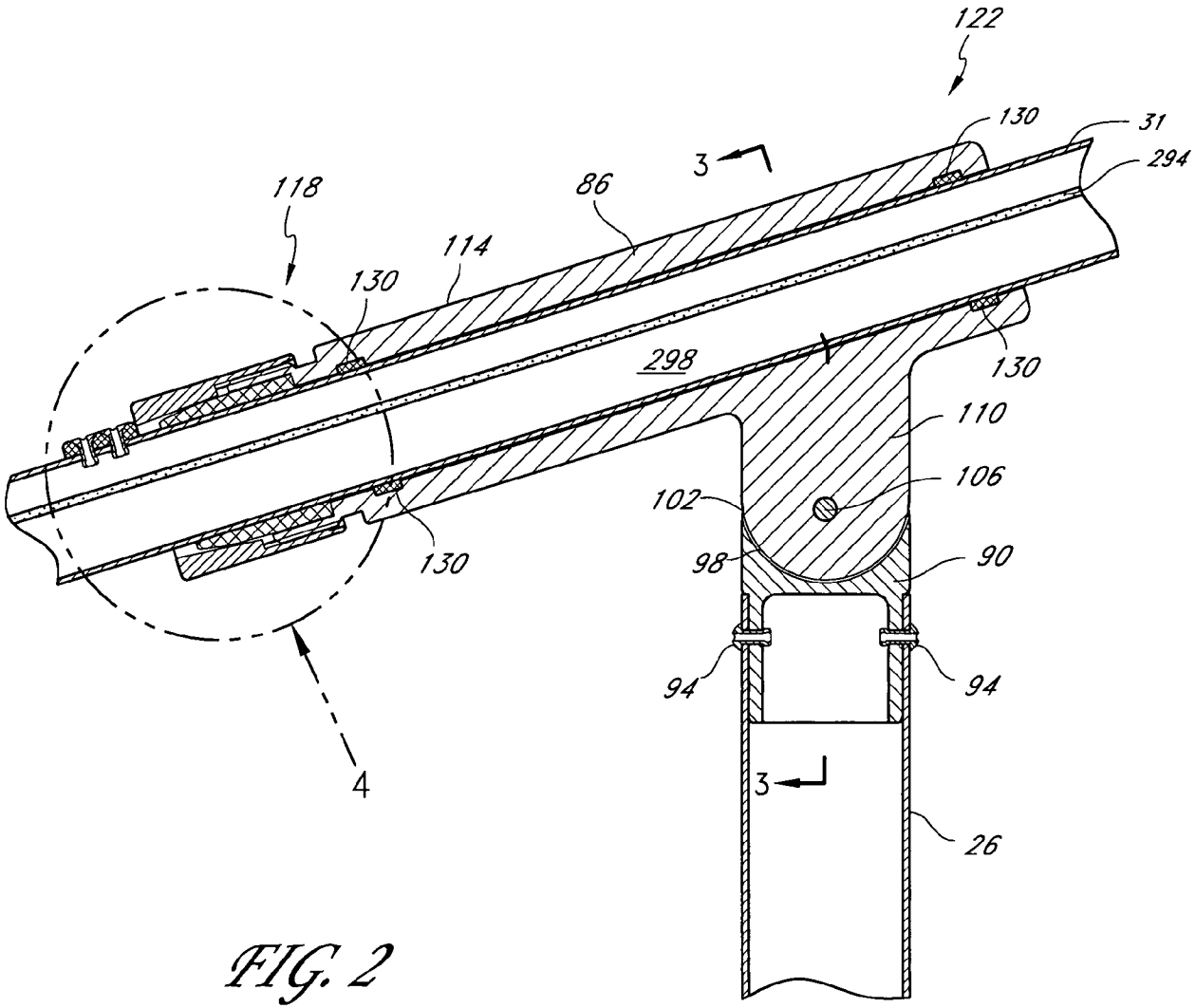
FIG. 2 is a partial cross-sectional view of the umbrella of FIG. 1, illustrating a portion of a mechanism for retracting and extending a canopy fabric.

In one embodiment, shown in FIG. 2, a holding sleeve 86 is positioned between the supporting tube 26 and the suspending tube 31. The holding sleeve 86 preferably is coupled with the suspending tube 31 and the supporting tube 26 and is configured such that the suspending tube 31 can be extended and retracted relative to the supporting tube 26. Thus, by sliding the suspending tube 31 through holding sleeve 86, the canopy assembly 18 can be moved away from or towards supporting pole 26. In one embodiment, a fitting 90 is coupled With the upper end 34 of the supporting tube 26. The fitting 90 can be coupled in any suitable manner, e.g., with one or more fasteners 94. In the illustrated embodiment, two fasteners 94 are provided, one on either side of the supporting tube 26. In the illustrated embodiment, the fitting 90 includes a curved upper surface 98 configured to support a curved lower surface 102 of the holding sleeve 86. The surfaces 98, 102 are configured to facilitate sliding motion of the surface 102 along the surface 98. In one embodiment, a pivot shaft 106 extends through a lower extension 110 of the holding sleeve 86. The lower extension 110 extends between a main body 114 of the holding sleeve 86 and the lower surface 102. The main body 114 also extends between the first end 118 and the second end 122. The first end 118 is closer to the first end 34 of the suspending tube 31 than is the second end 122, and the second end 122 is closer to the second end 38 of the suspending tube 31 than is the first end 118. The complementary curved surfaces 98 and 102 permit the holding sleeve 86 to be rotated about shaft 106. This enables supporting tube 31 to be correspondingly tilted so as to raise or lower canopy assembly 18.

As discussed above, the holding sleeve 86 is configured to permit the suspending tube 31 to be extended and retracted relative to the supporting tube 26. Extension and retraction can be provided in any suitable manner. For example, the holding sleeve 86 can have formed therein, e.g., within the main body 114, a passage defined by an inner wall 124. The passage preferably is slightly bigger than the suspending tube 31. As such, the suspending tube 31 can slide within the passage of the main body 114 between an extended and a retracted configuration or position. The holding sleeve 86 can be further configured to make such sliding motion smoother. For example, one or more bushings 130 can be positioned between the main body 114 and the suspending tube 31 to reduce friction between the main body 114 and the suspending tube 31. The bushing 130 can take any suitable form, for example being constructed of a low friction material, e.g., a durable low friction plastic. In one embodiment, at least one of the bushings 130 is a plastic ring configured to reduce friction between the suspending tube 31 and the sleeve 86. In the illustrated embodiment, in FIG. 2, two bushings 130 are provided with one bushing being located adjacent the second end 122 and one being located adjacent the first end 118 of the main body 114 of the holding sleeve 86. In other arrangements, other types of bearings could be substituted for one or more of the bushings 130. For example, one or more roller bearings could be substituted for one or more of the bushings 130.

In some embodiments, in addition to being able to be extended and retracted, it is useful to configure the support pole assembly 14 to fix the relative position of the supporting tube 26 and the suspending tube 31, more particularly to fix the suspending tube 31 at a desired position so that the canopy assembly 18 is placed where described relative to the support pole 26.

Figure 4:
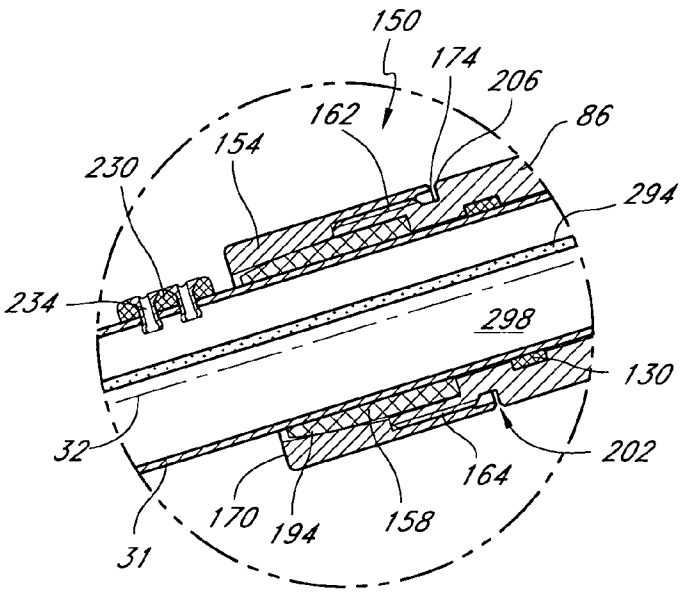
FIG. 4 is a cross-sectional detail view taken at section 4-4 illustrating one embodiment of a locking device in a first configuration.
Figure 5:
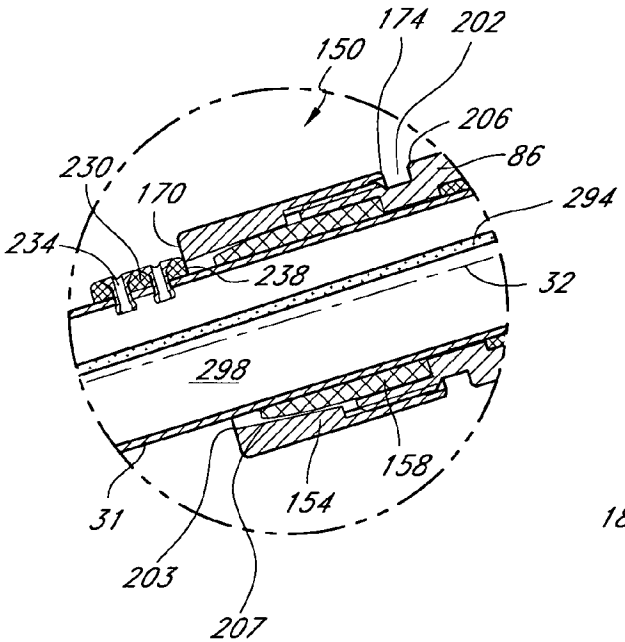
FIG. 5 is a cross-sectional detail view of the locking device of FIG. 4 illustrating a second configuration of the locking device.

FIGS. 4 and 5 illustrate one embodiment of a locking device 150 that can be provided to fix the position of the suspending tube 31 relative to the supporting tube 26. The locking device 150 preferably comprises an advanceable member 154 and a wedge member 158. The advanceable member 154 preferably is coupled with the first end 118 of the holding sleeve 86. In one embodiment, internal threads 162 are provided on an inside surface of the advanceable member 154 and external threads 164 are provided on an outer surface of the holding sleeve 86. The threads 162, 164 can be provided in any suitable manner, e.g., by forming the threads on a surface of the advanceable member 154 and the holding sleeve 86. The external threads 164 can be provided adjacent the second end 118 of the holding sleeve 86. The advanceable member 154 can be configured as a ring or sleeve that can extend around the suspending tube 31. In one embodiment, the advanceable member includes a first end 170 an a second end 174. The first end 170 is the end of the advanceable member 154 closest to the first end 34 of the suspending tube 31. In one embodiment, the internal threads 162 are formed near the second end 174 of the advanceable member 154 and extend toward the first end 170. Preferably, the internal threads 162 extend about half of the distance between the second end 174 and the first end 170.

Figure 6:
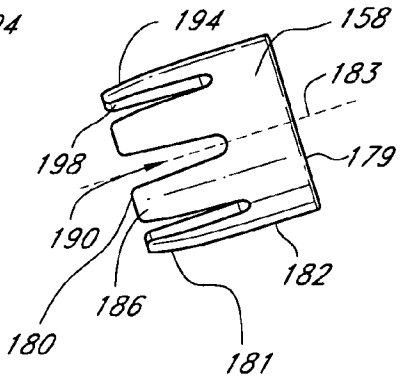
FIG. 6 is a plan view of one embodiment of a wedge member comprising a portion of the locking device of FIG. 4.

The wedge member 158 can take any suitable form, but generally comprises a ring or sleeve that can extend around the suspending tube 31. Wedge member 158 comprises a distal end 179 and a proximal end 180. Wedge member 158 preferably comprises an external ramp surface 181 that tapers towards inwardly towards the proximal end 180. In a preferred embodiment, shown in FIG. 6, the wedge member 158 comprises a ring portion 182 that extends around a central axis 183 and a plurality of elongate members 186 that extend from the ring portion 182 in a direction generally parallel to that axis. Each pair of elongate members 186 is separated by a gap 190. Each of the elongate members 186 includes an outer surface 194, that preferably provides ramp surface 181, and an inner surface 198. The inner surface 198 is a gripping surface in some embodiments, as discussed further below.

When the locking device 150 is assembled, the wedge member 158 is positioned adjacent the first end 118 of the holding sleeve 86. In one arrangement, an annular channel or recess is formed at the first end 118 of the holding sleeve 86 to receive the ring member 182 of the wedge member 158. An outside surface of the holding sleeve 86 opposite the annular recess comprises the external threads 164. The advanceable member 154 is placed over the wedge member 158, is advanced until the internal threads and external threads 162, 164 engage, and is further advanced until an internal surface of the advanceable member 154 engages the external surface 194 of the elongate members 186 of the wedge member 158. As will be discussed further below, further advancement of the advanceable member 154 toward the second end 122 of the holding sleeve 86 increases the force applied by a gripping surface of the wedge member 158 to the suspending tube 31. The force is increased until the tendency of the suspending tube 31 to be extended or retracted or to rotate about its longitudinal axis is substantially reduced or eliminated.

FIGS. 4 and 5 illustrate two configurations of a locking device 150. In FIG. 4, a gap 202 is formed between a second end 174 of the advanceable member 154 and a shoulder 206 of the main body 114 of the holding sleeve 86. The shoulder 206 is adjacent the first end 118 of the holding sleeve 86. In the configuration of FIG. 4, the gap 202 is relatively small. FIG. 5 illustrates a second configuration wherein the gap 202 between the second end 174 of the advanceable member 154 and the shoulder 206 of the holding sleeve 86 is greater. In the configuration of FIG. 5, the force applied by the internal surface 203 of the advanceable member 154 to the external surface 194 of the wedge member 158 is decreased, such that the force applied to the suspending tube 31 by the gripping surface 198 is decreased so as to permit the suspending tube 31 to be extended or retracted relative to the holding sleeve 86 and to permit the suspending tube 31 to rotate about the axis 32. This is preferably achieved by means of an internal ramp surface 207 on internal surface 203 that tapes outwardly moving in a direction away from the first end 170 of the advanceable member 154. Thus, as the advanceable member 154 is advanced by means of progressive engagement of internal and external threads 162 and 164, the ramp surface 207 of the advanceable member 154 gradually slides up ramp surface 181 of wedge member 158 increasing the force applied to suspending tube 31. Elongate members 186 of wedge member 158 conveniently provide some flexibility in wedge member 158 to accommodate and transmit this force to suspending tube 31.

FIG. 5 illustrates that in one embodiment, a limiter device 230 can be provided to limit the degree of extension of the suspending tube 31 relative to the holding sleeve 86. The limiter device 230 is coupled with the suspending tube 31. In one embodiment, one or more fasteners 234 are provided to couple the limiter 230 with the suspending tube 31. In one embodiment, the limiter device 230 limits the movement of the advanceable member 154 relative to the holding sleeve 86. In another embodiment, the limiter device 230 limits both the degree of extension of the suspending tube 31 relative to the supporting tube 26 and the movement of the advanceable member 154. In one arrangement, the limiter device 230 has a surface 238 that engages the first end 170 of the advanceable member 154.

Figure 7:
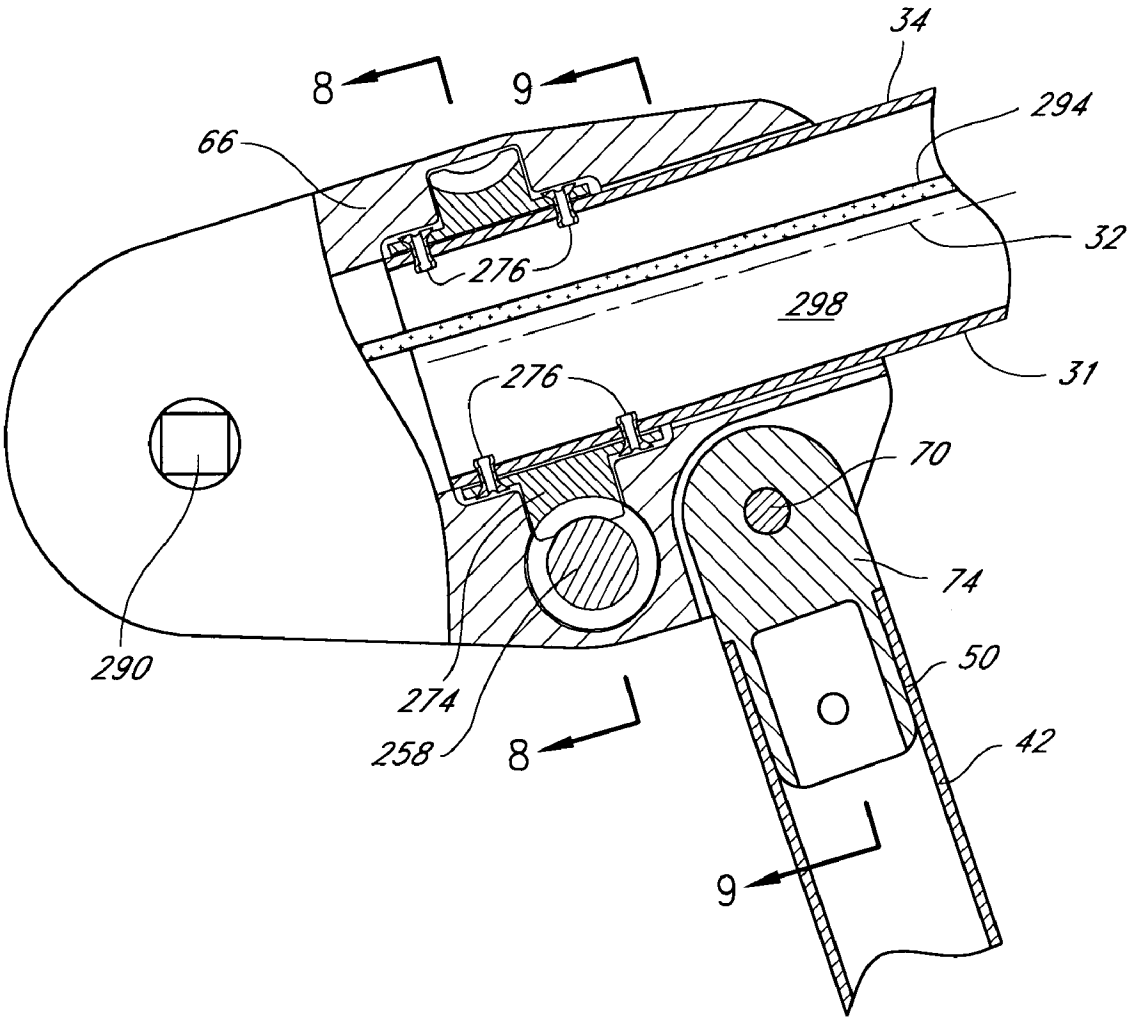
FIG. 7 is a partial cross-sectional detail view taken at section 7-7 illustrating one embodiment of a mechanism for tilting a canopy assembly.
Figure 8:
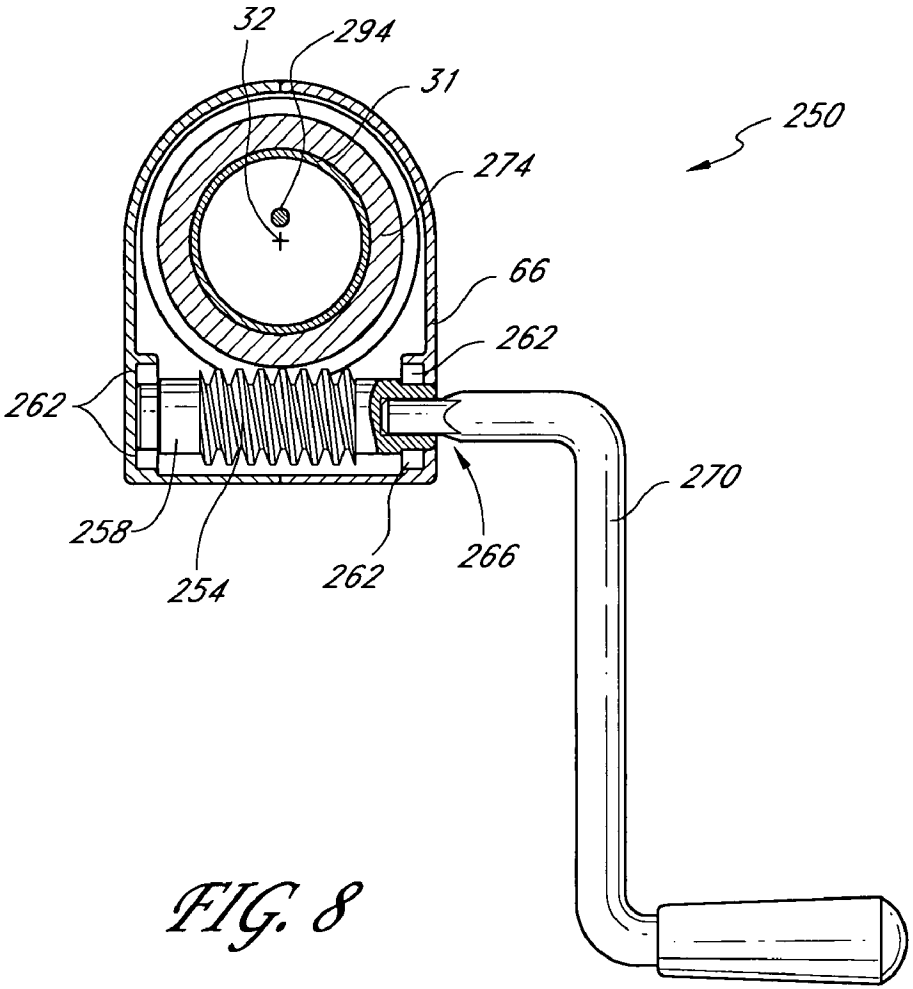
FIG. 8 is a cross-sectional view taken at section 8-8 in FIG. 7, with a worm gear shown in partial cross-section.

FIGS. 7 and 8 illustrate one embodiment of a tilting device 250 that can be used to tilt the suspending tube 31 about its longitudinal axis 32. This tilting enables the canopy assembly 18 and canopy fabric 22 coupled therewith to be tilted to provide shelter in the needed direction. In one embodiment, the tilting device 250 is coupled with the first end 34 of the suspending tube 31. For example, the tilting device 250 can be coupled with an outer surface of the suspending tube 31. As used in this context, the outer surface need not necessarily be an external surface (i.e., one that is exposed to the elements on the assembled umbrella), but can be a surface on the outside of the component, e.g., the suspending tube 31. In one arrangement, the tilting device 250 is at least partially housed within the housing 66. The tilting device 250 includes in one arrangement a worm gear 254 that is pivotably coupled within the housing 66. The worm gear 254 can be mounted on a shaft 258 that is supported at its opposite ends by a plurality of bearings 262. The tilting device 250 also includes a tilt engagement feature 266 into which a crank member 270 can be inserted and which the crank member 270 engages when the crank member 270 is rotated, the shaft 258 and worm gear 254 are rotated about an axis of the shaft 258. The tilting device 250 preferably also includes a plurality of gear teeth 274 that are coupled with the suspending tube 31. In one arrangement, the gear teeth 274 are coupled with an outer surface of the suspending tube 31. The plurality of gear teeth 274 can be formed in any suitable manner, e.g., as a portion of the ring gear mounted to the suspending tube 31. The ring gear can be mounted in any suitable manner, e.g., with a plurality of fasteners 276 extending through the ring gear and through the suspending tube 31.

The tilting device 250 provides many advantages. First, it enables the suspending tube 31 to be rotated through a fairly wide range of positions. For example, in one arrangement, the tilting device 250 is configured to tilt the suspending tube 31 and the canopy assembly 18 to any position between about plus 90 degrees and about minutes 90 degrees from vertical. In another arrangement, the suspending tube 31 and the canopy assembly 18 can be rotated through 360 degrees of motion. Also, the use of the worm gear 254 greatly increases the mechanical advantage of the mechanism. This enables less force applied to the crank member 270 to cause the canopy assembly 18 to be positioned. As a result, it is not required that the user be extremely strong. This is advantageous for the elderly, the disabled, and the very young users.

In one arrangement, the housing 66 also includes a canopy deployment engagement feature 290. The canopy deployment engagement feature 290 can include an aperture into which a crank member, e.g., the crank member 270, can be inserted to engage a mechanism that causes the canopy assembly 18 to be opened and closed. One arrangement provides a drum (not shown) on which a tension member 294 is wound. The tension member 294 extends between the drum and the second end of the suspending tube 31 within a passage 298 formed in the suspending tube 31. The tension member 294 also extends to a portion of the canopy assembly 18 and engages a member that causes a canopy frame of the canopy assembly 18 to open and close. In one arrangement, as tension is applied to the tension member 294, a force is transferred to the canopy frame of the canopy assembly 18. This force raises a lower portion of the canopy frame relative to an upper portion such that canopy frame members spread outward and move to an open configuration. The canopy frame can be arranged on a rib assembly as discussed above.

Figure 13:
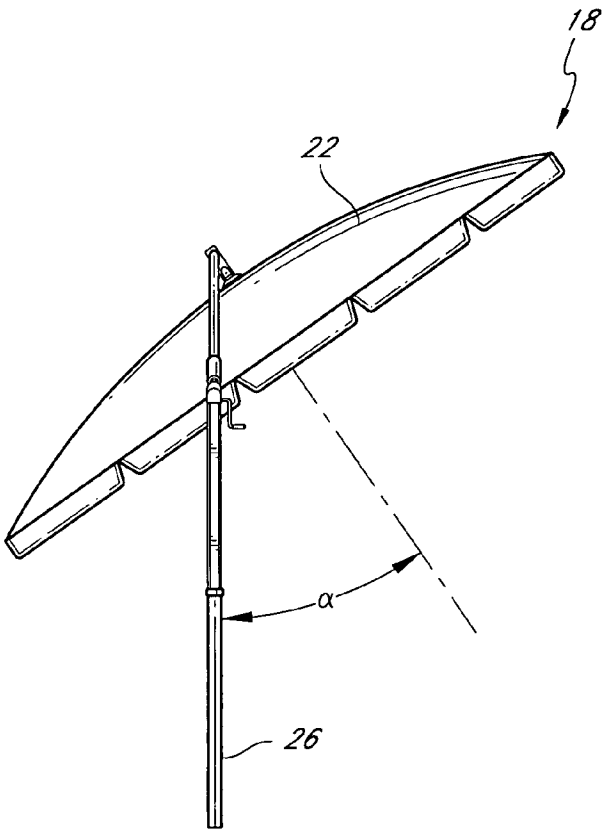
FIG. 13 illustrates the third open configuration of the umbrella of FIG. 1.
Figure 12:
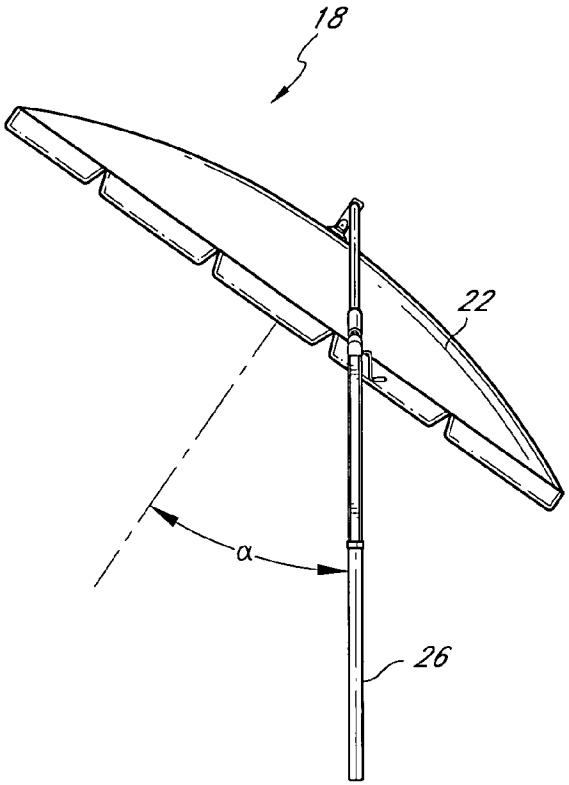
FIG. 12 shows a second open configuration of the umbrella of FIG. 1.
Figure 11:
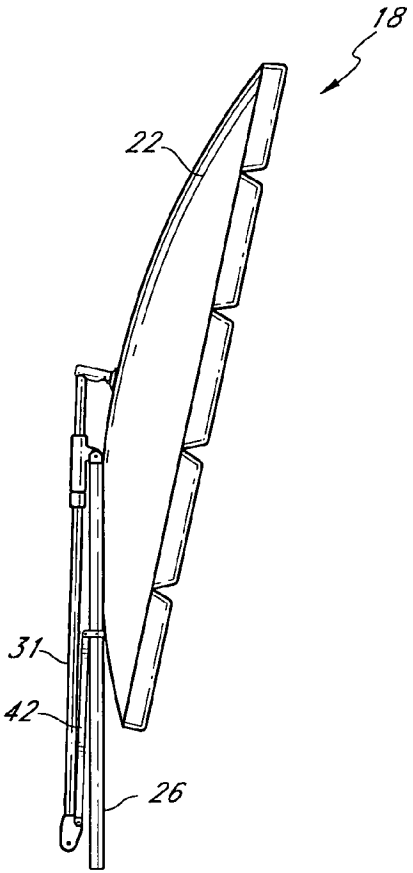
FIG. 11 shows a first open configuration of the umbrella of FIG. 1.

The structure of the embodiments of the umbrella 10 discussed above provide a plurality of advantageous configurations. Such configurations include a variety of tilted positions as illustrated in FIGS. 11-13. FIG. 11 shows a first open configuration of the umbrella 10 of FIG. 1. In the open configuration of FIG. 11, the canopy assembly 18 is open, but the suspending tube 31 is retracted relative to the holding sleeve 86. The suspending tube 31 is retracted such that the canopy fabric 22 of the canopy assembly 18 is adjacent to, e.g., touching, the supporting tube 26. This arrangement provides shelter from the elements, e.g., the sun, wind or rain, coming from a direction to the left of the page. The configuration of FIG. 11 is also advantageous in, that the suspending tube 31 and the supporting tube 26 provide a very compact arrangement. In particular, in this configuration, the suspending tube 31 and supporting tube 26 are adjacent to each other in a substantially parallel arrangement with only the strut 42 interposed therebetween.

FIGS. 12 and 13 illustrate additional open configurations of the umbrella 10. In the configuration of FIG. 12, the canopy assembly 18 and the suspending tube 31 are tilted by the titling device 250 to an angle a relative to the vertical. This configuration provides shelter from the elements being directed from above and to the right of the canopy assembly 18. More particularly, an angle alpha is defined between the vertical, which here corresponds with a central axis of the supporting tube 26, and an axis extending through the center of the canopy assembly 18 perpendicular to a plane include the lower side of the canopy fabric 22. As discussed above, the angle alpha can be any suitable angle to provide the necessary sheltering. In the illustrated embodiment, the angle alpha is approximately +45°. However, any angle up to and including +90° can be achieved for the configuration of FIG. 12.

FIG. 13 illustrates a third configuration in which a negative tilt angle is provided. In the illustrated embodiment, alpha is approximately −45°. However, as discussed above, the angle alpha can be any suitable angle, up to and including −90°. The angle alpha, as discussed above, can be any angle between zero and 360° in some applications.

Figure 11A:
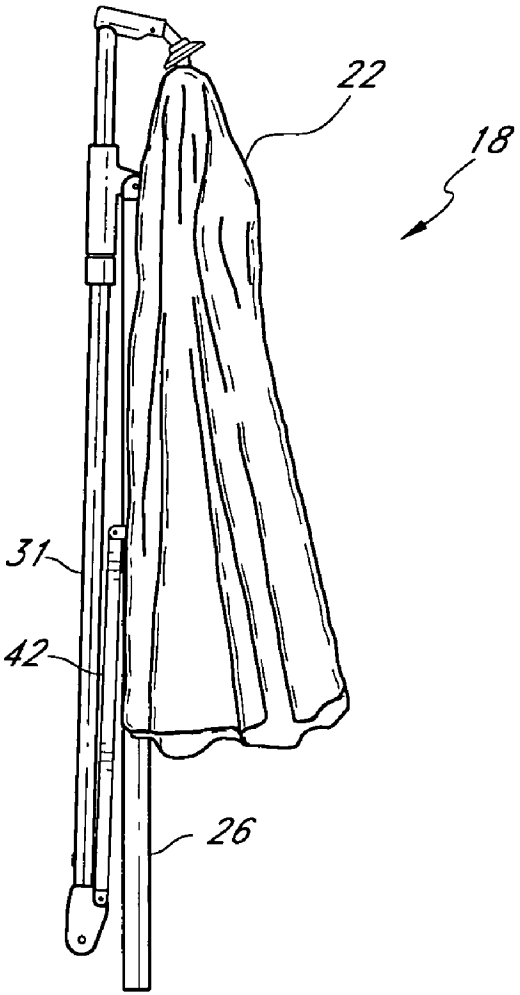
FIG. 11A shows a closed, retracted configuration of the umbrella of FIG. 1.

A storage or retracted position of the umbrella is illustrated in FIG. 11A. In this position the suspending tube 31 is substantially parallel and adjacent to the support pole 26.

This disclosure includes all permutations of the independent claims with their dependent claims.

What is claimed is:

1. An umbrella assembly comprising:

a support pole assembly, comprising:

a supporting pole having a lower end and an upper end;

a holding sleeve coupled with the upper end of the supporting pole, the holding sleeve including a first end and a second end;

a suspending tube extending through the holding sleeve and having a first end, a second end, and a longitudinal axis; and a canopy assembly coupled with the second end of the suspending tube for suspending a canopy fabric; and a tilting device comprising:

a worm gear coupled with a shaft rotatably journaled on the support pole assembly and configured to be driven by a crank member; and a plurality of gear teeth coupled with an outer surface of the suspending tube adjacent the first end thereof wherein the gear teeth are engaged by the worm gear such that rotation of the worm gear causes the suspending tube to rotate about said longitudinal axis.

2. The umbrella assembly of claim 1, wherein the gear teeth are formed on a ring gear mounted on the suspending tube.

3. The umbrella assembly of claim 1, further comprising:

a canopy deployment mechanism;

a crank handle;

a housing located adjacent the first end of the suspending tube in which the shaft is rotatably journaled, the housing and the shaft each including a tilt engagement feature into which the crank handle can be inserted into driving engagement with the shaft and the worm gear, the housing also having a canopy deployment engagement feature into which the crank handle can be inserted to operate the canopy deployment mechanism to open and close the canopy assembly.

4. The umbrella assembly of claim 1, further comprising a strut having an upper end and a lower end, the lower end being coupled with the support pole and the upper end being coupled with the suspending tube adjacent the first end thereof.

5. The umbrella assembly of claim 4, wherein the upper end of the strut is pivotably connected with the suspending tube and the lower end of the strut is pivotably connected with the supporting pole such that the strut pivots as the suspending tube is extended or retracted relative to the holding sleeve.

6. The umbrella assembly of claim 1, further comprising a locking device having a first configuration preventing movement of the suspending tube relative to the holding sleeve and a second configuration permitting movement of the suspending tube relative to the holding sleeve.

7. The umbrella assembly of claim 6, wherein the locking device comprises an advanceable member advanceable over the suspending tube and coupled with the holding sleeve and a wedge member having a gripping surface facing the suspending tube, wherein a friction force directed from the gripping surface to the suspending tube is increased as the advanceable member is advanced relative to the holding sleeve.

8. The umbrella assembly of claim 7, wherein the advanceable member comprises a ring having internal threads, the first end of the holding sleeve comprising external threads configured to mate with the internal threads of the ring, and wherein the wedge member is located between the ring and the holding sleeve, whereby rotation of the ring about the longitudinal axis of the suspending tube advances the ring relative to the holding sleeve to increase the friction force directed from the gripping surface to the suspending tube.

9. The umbrella assembly of claim 8, further comprising a limiter device coupled with the suspending tube to limit the movement of the ring relative to the holding sleeve.

10. The umbrella assembly of claim 1, wherein the holding sleeve permits movement of the suspending tube relative to the holding sleeve between an extended position and a retracted position.

11. The umbrella assembly of claim 10, wherein the holding sleeve is pivotably coupled with the supporting pole and the upper end of the strut is pivotable with respect to the suspending pole and the lower end of the strut is pivotable with respect to the support pole, such that the first end of the suspending tube is movable toward a lower end of the support pole as the suspending tube is retracted.

12. The umbrella assembly of claim 10, wherein the suspending tube is moveable between the extended and the retracted positions without changing the elevation of the lower end of the strut.

13. The umbrella assembly of claim 1, wherein the tilting device is capable of rotating the suspending tube through 360 degrees.

14. The umbrella assembly of claim 1, wherein the tilting device is configured to tilt the canopy assembly to any position between about +90 degrees and about −90 degrees from vertical.

15. An umbrella assembly comprising:

a support pole having a lower end and an upper end;

a suspending tube having first and second ends and a longitudinal axis and being coupled with the support pole, the suspending tube being movable relative to the support pole between an extended position and a retracted position, wherein the second end is farther from the support pole in the extended position than in the retracted position; and a canopy assembly coupled with the second end of the suspending tube for suspending a canopy fabric;

a first mechanism for rotating the suspending tube about its longitudinal axis, comprising a driven member coupled with an external surface of the suspending tube, the first mechanism configured to transmit a force to the driven member to cause the suspending tube to rotate in either direction about said axis upon movement of the driven member and to thereby cause the canopy to tilt in either direction about said axis; and a second mechanism permitting retraction and extension of the suspending tube relative to the support pole, the second mechanism comprising a gripping member configured to apply sufficient force to an external surface of the suspending tube to fix the position of the suspending tube relative to the support tube.

16. The umbrella assembly of claim 15, wherein said driven member comprises a first set of gear teeth mounted to said external surface of said suspending tube, said first mechanism further comprising a second set of gear teeth mating with said first set and capable of being driven by a crank.

17. The umbrella assembly of claim 16, further comprising a mechanism for opening and closing the canopy assembly, said mechanism capable of being driven by a crank and wherein both said mechanism and the mechanism for rotating the suspending tube are located in a housing attached to the first end of the suspending tube.

18. An umbrella comprising:

a support pole, at least a portion of which extends upwardly in use;

a suspending pole, mounted transversely to the support pole and having first and second ends and a longitudinal axis;

a canopy suspended in use from the second end of the suspending pole;

a mechanism for rotating the suspending pole about its longitudinal axis, comprising a ring gear comprising a plurality of gear teeth mounted on an external surface of the suspending pole, the mechanism configured to cause the suspending pole to rotate in either direction about said axis upon movement of the gear teeth and to thereby cause the canopy to tilt in either direction about said axis;

wherein the mechanism for rotating further comprises a worm gear configured to be driven by a crank handle, the worm gear journaled for rotation and being mounted in relation to the ring gear to drive the ring gear when the worm gear is driven by the crank handle.

19. The umbrella assembly of claim 18, further comprising a locking device having a first configuration preventing movement of the suspending pole relative to the support pole and a second configuration permitting movement of the suspending pole relative to the support pole.

20. The umbrella assembly of claim 18, further comprising:

a locking device having a first configuration preventing movement of the suspending pole relative to the support pole and a second configuration permitting movement of the suspending pole relative to the support pole;

wherein the locking device further comprises:

a ring member advanceable relative to the suspending pole; and a wedge member having a gripping surface facing the suspending pole, wherein a friction force directed from the gripping surface to the suspending pole is increased as the ring is advanced along the suspending pole.

21. An umbrella comprising:

a support pole, at least a portion of which extends upwardly in use;

a suspending pole, mounted transversely to the support pole and having first and second ends and a longitudinal axis;

a canopy suspended in use from the second end of the suspending pole;

a mechanism for rotating the suspending pole about its longitudinal axis, comprising a plurality of gear teeth coupled with the suspending pole to cause the suspending pole to rotate in either direction about said axis upon movement of the gear teeth and to thereby cause the canopy to tilt in either direction about said axis;

a locking device having a first configuration preventing movement of the suspending pole relative to the support pole and a second configuration permitting movement of the suspending pole relative to the support pole; and a limiter device coupled with the suspending pole to limit the movement of the ring relative to the suspending pole.

22. An umbrella comprising:

a support pole, at least a portion of which extends upwardly in use;

a suspending pole, mounted transversely to the support pole and having first and second ends and a longitudinal axis;

a canopy suspended in use from the second end of the suspending pole; and a mechanism for rotating the suspending pole about its longitudinal axis, comprising a plurality of gear teeth coupled with the suspending pole to cause the suspending pole to rotate in either direction about said axis upon movement of the gear teeth and to thereby cause the canopy to tilt in either direction about said axis;

wherein said canopy comprises a rib assembly comprising a plurality of ribs extending from a central shaft, a natural or synthetic material extended over the ribs, said ribs being movable along said shaft to open and close the canopy, said umbrella further comprising a mechanism for opening and closing a canopy, said mechanism comprising:

a drum, rotatable by a crank;

a cable wound on said drum and extending inside the suspending pole generally along its longitudinal axis to such rib assembly, so that winding or unwinding said cable causes the rib assembly to move up or down said shaft.

23. The umbrella assembly of claim 22, wherein said mechanism for rotating the suspending pole and said mechanism for opening and closing the canopy are mounted adjacent the first end of the supporting pole and enclosed by a housing, said housing having openings for receiving a crank handle to operate said mechanisms.

* * * * *

UNITED STATES PATENT AND TRADEMARK OFFICE

CERTIFICATE OF CORRECTION

PATENT NO. : 7,493,909 B2
APPLICATION NO. : 11/211127
DATED : February 24, 2009
INVENTOR(S) : Oliver Joen-an Ma It is certified that error appears in the above-identified patent and that said Letters Patent is hereby corrected as shown below:

In Column 1, Page 2, please add "6,435,444 B1 8/2008 Lin" to the List of References.

In Column 5, line 40, please change "With" to -- with --.

Signed and Sealed this

Fourth Day of August, 2009

John Doll

JOHN DOLL
*Acting Director of the United States Patent and Trademark Office*